United States Patent [19]

Johnson

[11] 4,263,859

[45] Apr. 28, 1981

[54] THREAD HANDLING SYSTEM FOR A SEWING MACHINE

[75] Inventor: Ralph E. Johnson, Convent Station, N.J.

[73] Assignee: The Singer Company, Stamford, Conn.

[21] Appl. No.: 91,924

[22] Filed: Nov. 7, 1979

[51] Int. Cl.[3] ..... D05B 49/02

[52] U.S. Cl. ..... 112/184; 112/242; 112/250; 112/255

[58] Field of Search ..... 112/241, 242, 250, 254, 112/255, 184

[56] References Cited

U.S. PATENT DOCUMENTS

| | | | |
|---|---|---|---|
| 171,558 | 12/1875 | Gibbs | 112/254 |
| 276,113 | 4/1883 | Willcox et al. | 112/241 |
| 331,026 | 11/1885 | Bigelow | 112/241 X |
| 908,434 | 12/1908 | Woodward | 112/242 |
| 1,389,000 | 8/1921 | Hill | 112/241 |
| 2,158,197 | 5/1939 | Pikul | 112/255 X |
| 3,347,195 | 10/1967 | Gegauf | 112/254 |
| 3,587,495 | 6/1971 | Johnson | 112/241 X |
| 4,111,140 | 9/1978 | Gonnai et al. | 112/254 |

*Primary Examiner*—Wm. Carter Reynolds
*Attorney, Agent, or Firm*—William V. Ebs; Robert E. Smith; Edward L. Bell

[57] ABSTRACT

A thread handling system for a sewing machine is provided with a tensioning device without a check spring, a thread takeup member for pulling thread from the tensioning device and setting stitches, and a thread holder including a pair of elongated members which grasp and meter thread to a needle and looptaker. The tensioning device is disposed with respect to the operating limits of the takeup member to enable thread to be withdrawn from the tensioning device without being pulled from the thread source and with only slight thread tension.

11 Claims, 11 Drawing Figures

THREAD HANDLING SYSTEM FOR A SEWING MACHINE

BACKGROUND OF THE INVENTION

1. Field of the Invention

The invention relates to thread handling systems for lockstitch sewing machines.

2. Description of the Prior Art

Conventional thread handling systems in lockstitch sewing machines include a tensioning device with a check spring, and a takeup member which pulls thread through the tensioning device from a spool and sets a stitch during an up stroke, and which supplies thread for use by a needle and looptaker during a down stroke. Various irregularities often occur in the stitches and material sewn with such systems due to the action of the check spring, the presence of excessive slack in the needle thread when tension is required to force the thread into the throat of the looptaker, and the inability of the tensioning device to supply thread at a light tension in response to a demand by the looptaker. The irregularities include a varying degree of tightness in first stitches, the occurrence of haloing characterized by the formation of slack loops in stitches as described for example in U.S. Pat. No. 4,095,539, the puckering of material, and skipped stitches. Furthermore, conventional thread handling systems severely limit the thickness of materials which can be satisfactorily sewn on a machine. The conventional systems also prevent the work feeding operation and needle penetration of the work to be timed so as to satisfactorily meet stitch forming requirement while avoiding damage to the needle.

SUMMARY OF THE INVENTION

The thread handling system of the invention for use in a lockstitch sewing machine provides for the formation of first stitches in like manner to subsequent stitches, minimizes haloing, prevents puckering, enables the sewing of thicker materials than can be handled with conventional systems, and allows the work feeding time to be advanced such that problems associated with needle penetration may be avoided. Such thread handling system includes a thread holder with elongated members which grasp and meter thread to a needle and looptaker at least as initially required by the looptaker of the machine. The system further includes a tensioning device without the usual check spring. Thread from a source extends to the tensioning device and beyond the tensioning device the thread extends to the thread holder. Beyond the thread holder the thread extends to the needle. A takeup, which brackets the thread holder, sets stitches and pulls thread through the tensioning device. The takeup moves the thread in one direction in the holder to a stitch setting position at one end of its operating range, and moves in the opposite direction free of thread to the other end of its operating range after which thread in the holder moves to a position of reengagement with the takeup to shorten the path for thread between the tensioning device and needle such that a quantity of thread is thereby supplied for use by the needle and looptaker. The tensioning device and needle such that a quantity of thread is thereby supplied for use by the needle and looptaker. The tensioning device is provided with thread guiding means and is disposed on one side of the elongated members of the thread holder in a position relative to the operating limits of the takeup to enable thread while the takeup is in the said other end of its operating range to be withdrawn from the tensioning device without being pulled from the thread source and with less tension in the thread than when pulled from the thread source by operation of the takeup.

DESCRIPTION OF THE PREFERRED EMBODIMENT

Figure 1:
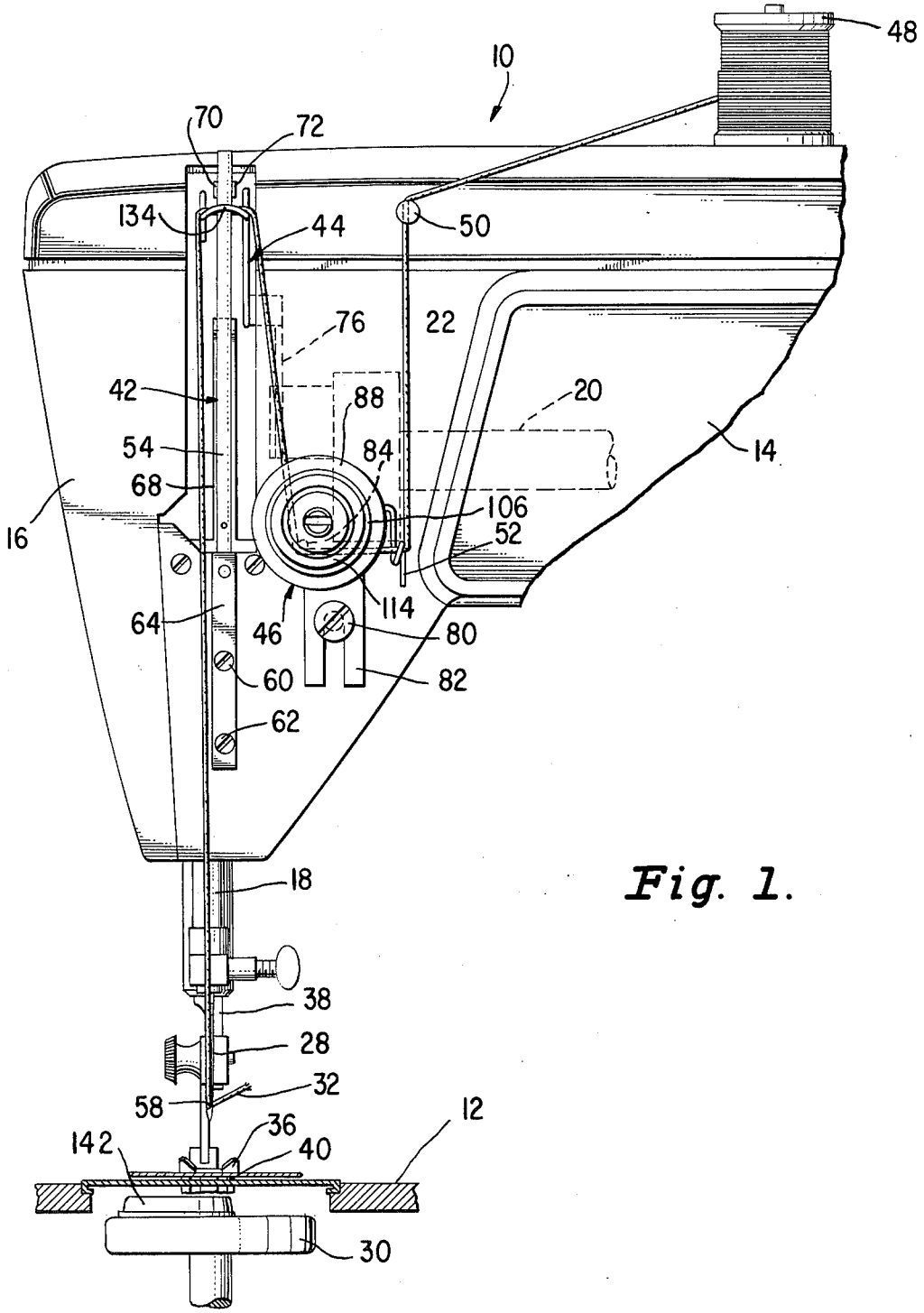
FIG. 1 is a front elevational view of a head end portion of a sewing machine including the thread handling system of the invention.
Figure 2:
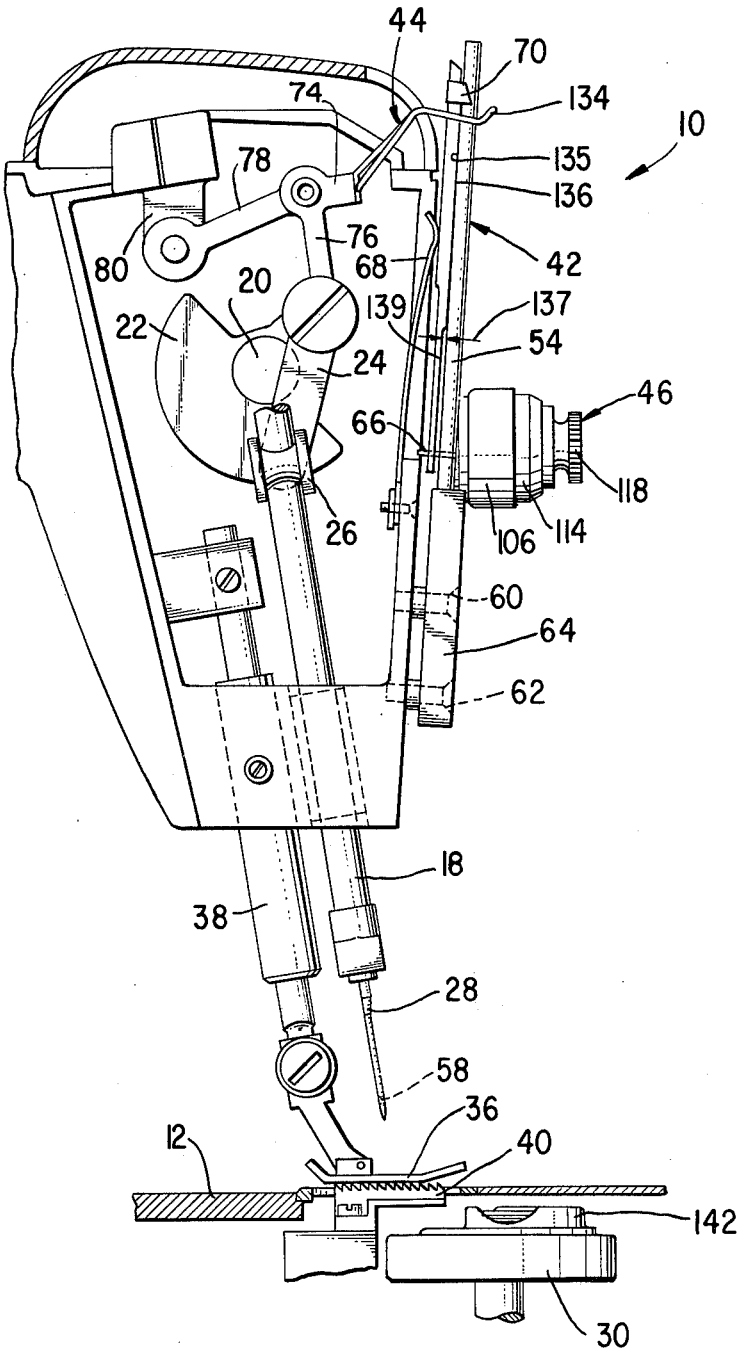
FIG. 2 is an end elevational view of the head end portion of the machine with the end cover removed.

Referring to the drawings and in particular to FIGS. 1 and 2, reference character 10 designates a portion of a lockstitch sewing machine including a work supporting bed 12, a bracket arm 14 and sewing head 16. A needle bar 18 is carried in the sewing head for endwise reciprocation by a rotating arm shaft 20 acting through a counterbalanced crank 22, a connecting drive link 24 and finally a collar 26 which is pivotally connected to the needle bar. A sewing needle 28 is carried by the lower end portion of the needle bar 18 and cooperates with a rotary looptaker 30 journalled in the bed portion and driven in timed relationship to the arm shaft in a well known manner for concatenating needle thread 32 to form lockstitches with bobbin thread 34. A detailed description of the manner in which such lockstitches are formed may be found for example in U.S. Pat. No. 2,862,468 of R. E. Johnson for "Ornamental Stitch Sewing Machines" issued Dec. 2, 1958 and assigned to The Singer Company. A presser foot 36, affixed to a presser bar 38 is utilized to urge fabric into contact with a feed dog 40 by means of which work is advanced under the needle 28. The feed dog is moved in timed relationship to the needle and looptaker by conventional work feeding mechanism which may be of the type shown and described, for example, in U.S. Pat. No. 3,527,183 for "Work Feeding Mechanism for Sewing Machines" of The Singer Company, issued Sept. 8, 1972.

Thread 32 is supplied to the needle 28 by the thread handling system of the invention which includes a thread holder 42, a takeup member 44 and a tensioning device 46. As shown, the thread extends from a spool 48 through thread guides 50 and 52 to tensioning device 46. The thread passes through the tensioning device and thence into the thread holder 42 where it passes between elongated members 54 and 56 of the holder and over takeup member 44 which brackets the said members 54 and 56. Beyond holder 42, the thread extends to the needle where it is threaded through the eye 58.

Elongated member 54 of the thread holder 42 is secured to the front face of the sewing head 16 by screws 60 and 62 which extend through a base 64 integral with member 54 and into the head 16. The other elongated member 56 is slidably mounted at its lower end on a pin 66 affixed in member 54. Member 56 is biased toward member 54 by a leaf spring 68 and is maintained in alignment with member 54 by tabs 70 and 72 provided on the member 56 to bracket member 54.

Takeup member 44 is affixed to a stub arm 74 extending from one end of a link 76 which has its other end pivotally connected to crank 22. A link 78 pivotally connects at one end to the link 76 as shown and pivotally connects at the opposite end to a fixed member 80. Rotation of arm shaft 20 results in link 76 being driven by crank 22, and the link 76 guided in its motion by the link 78 imparts reciprocatory up-down motion to takeup member 44 along the elongated members 54 and 56 in timed relationship to the operation of the needle 28 and looptaker 30.

Figure 3:
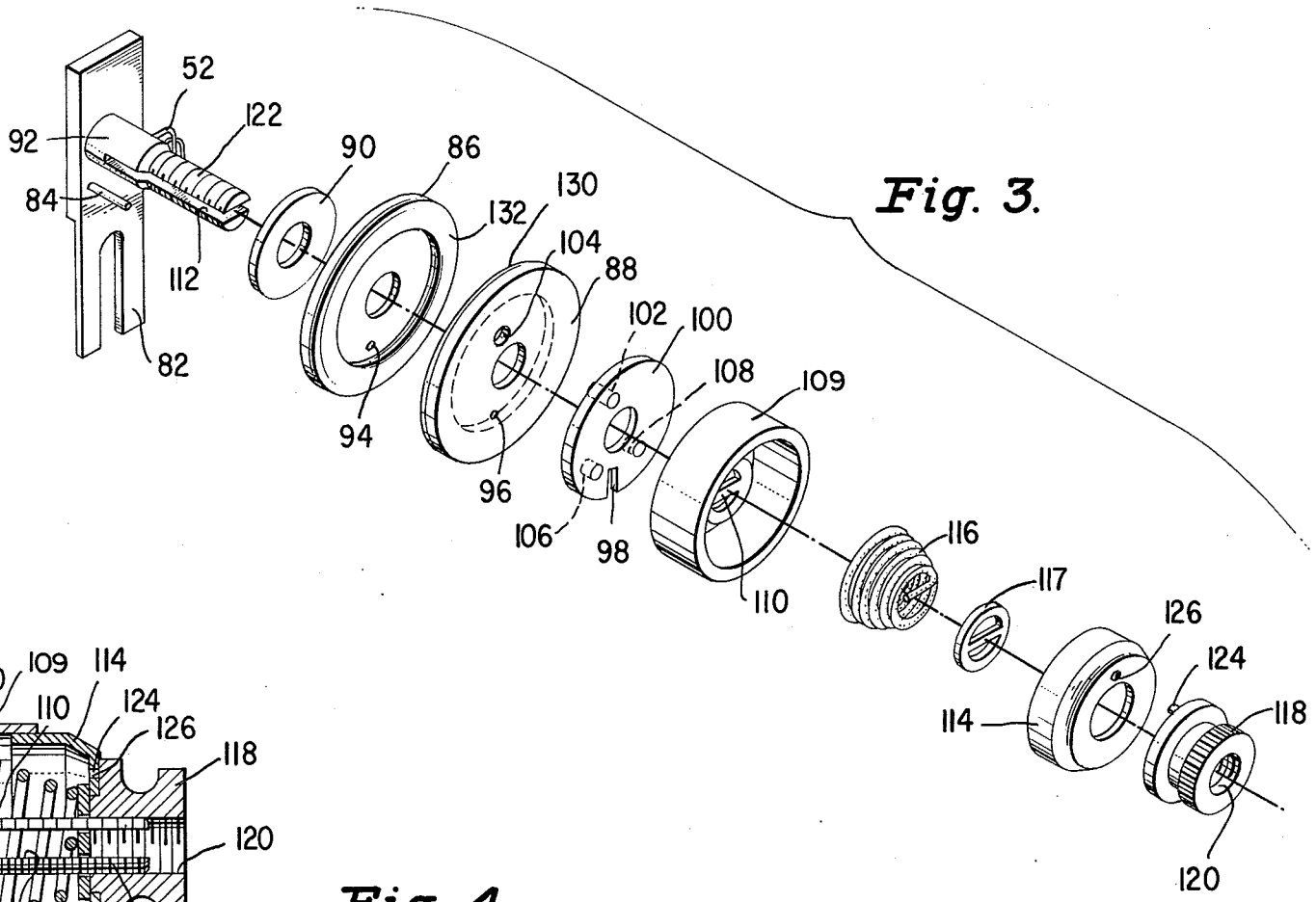
FIG. 3 is an exploded perspective view of the thread tensioning device of the system of the invention.
Figure 4:
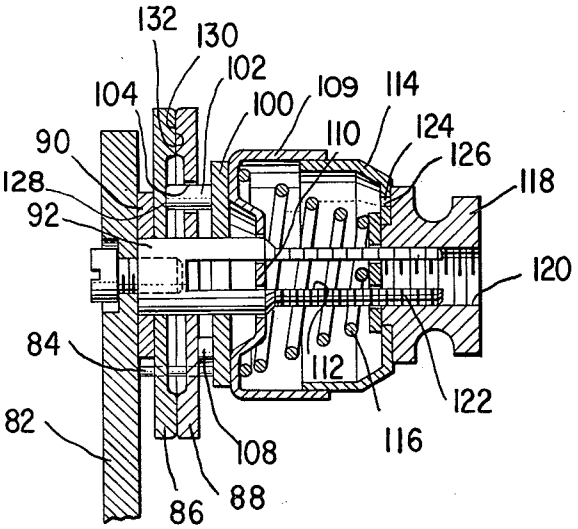
FIG. 4 is a vertical sectional view taken through the thread tensioning device.

Tensioning device 46 is mounted on the face of the machine by a screw 80 which engages a bracket 82 of the device and extends into the sewing head 16. The tensioning device is disposed to one side of the thread holder 42 in a position relative to the operating range of the takeup as described hereinafter. As shown in FIGS. 3 and 4, the tensioning device includes a fixed thread guiding pin 84 on bracket 82, and engageable tension plates 86 and 88 which are mounted next to a washer 90 on a shaft 92 affixed in the bracket 82. The washer 90 bears against bracket 82 as shown and plate 86 bears against the washer. Pin 84 extends through aligned openings 94 and 96 in the plates 86 and 88 respectively and projects into a slot 98 provided in a pressure plate 100 which is mounted on shaft 92 adjacent to plate 88. Plate 100 includes a fixed pin 102 which is located over shaft 92 and extends through an opening 104 in plate 88 to engage plate 86. Plate 100 also includes fixed pins 106 and 108 which are located below shaft 92 and bear against plate 86. A cup 109 is mounted on shaft 92 and prevented from turning by a central rib 110 thereon which extends through a slot 112 in the shaft. Another cup 114 is provided on shaft 92, and a helical coil spring 116 is provided on the shaft between the cup 109 and a ribbed ring 117 on shaft 92 adjacent cup 114. Cup 114 is turnable on shaft 92 by a knurled knob 118 having internal threads 120 which engage threads 122 provided on shaft 92, and having a fixed pin 124 thereon which engages the cup 114 in a hole 126. When cup 114 is turned in one direction by knob 118 spring 116 is caused to increasingly apply force to pressure plate 100. The engaging point 128 between plate 86 and pin 102 on plate 86 serves as a fulcrum for plate 100 and force is applied by pins 106 and 108 on plate 100 against the plate 88 tending to squeeze annular surface 130 on the plate 88 against opposing annular surface 132 on plate 86 and so apply tension in accordance with the position of knob 118 to thread when pulled through the tensioning device across such surfaces. Pins 106 and 108 are below the axis of shaft 92 as viewed in FIG. 1 and the fulcrum at 128 is above the axis. Plates 86 and 88 therefor apply greater tension to thread in the lower portion of the device than in the upper portion.

Thread from thread guide 52 enters the lower half of tensioning device 46 where it passes between surfaces 130 and 132 and under thread guiding pin 84. The thread extends beyond pin 84 to pass again across surfaces 130 and 132 and then exit from the tensioning device. The tensioning device is so located with respect to the operating range of takeup member 44 that thread is caused to exit from the tensioning device near the upper end thereof as the takeup member is moved into the top end of its operating range, and so that while the takeup member is at the bottom end of its operating range, thread may be obtained from the tensioning device with a lowering of the exit point of the thread from the device and without thread being pulled through the opposing annular surfaces where the thread enters the device.

During operation of the machine, up-down reciprocatory motion is imparted to the takeup member 44 as already described. As the takeup member moves upwardly from the lower end of its operating range, terminal portion 134 thereof extending across the thread holder moves thread upwardly between elongated members 54 and 56 and causes some thread to be pulled through tensioning device 46 from supply spool 48. As the takeup member moves into the upper end of its operating range a stitch is set in material being sewn. The takeup member causes the thread to exit from the tensioning device near its top edge when the member 44 is at the upper end of its operating range as shown in FIG. 1.

Figure 5:
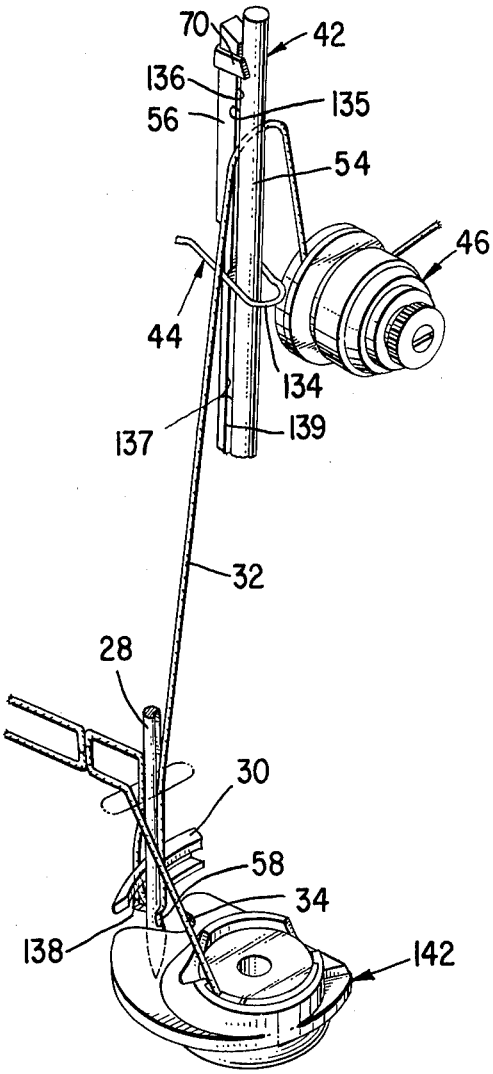
FIGS. 5, 6, 7 and 8 are diagramatic perspective views illustrating the operation of the thread handling system.

When the takeup member moves downwardly, it moves away from the thread which is then temporarily retained in thread holder 42 at its upper end between opposing surfaces 135 and 136 on fixed elongated member 54 and spring biased elongated member 56 respectively (see FIG. 5). The thread moves gradually downwardly in the thread holder in response to the usual demand by the needle 28 and looptaker 30, and reengages the terminal portion 134 of the takeup member 44 when the takeup member is at the lower end of its operating range. Opposing surfaces 135 and 136 cause light tension to be applied to the thread passing to the needle and looptaker during a first substantial part of the downward movement of the thread in the holder, however, during the latter part of its downward movement in thread holder 42 the thread falls freely through a gap 137 formed by a step 139 in surface 136.

Figure 6:
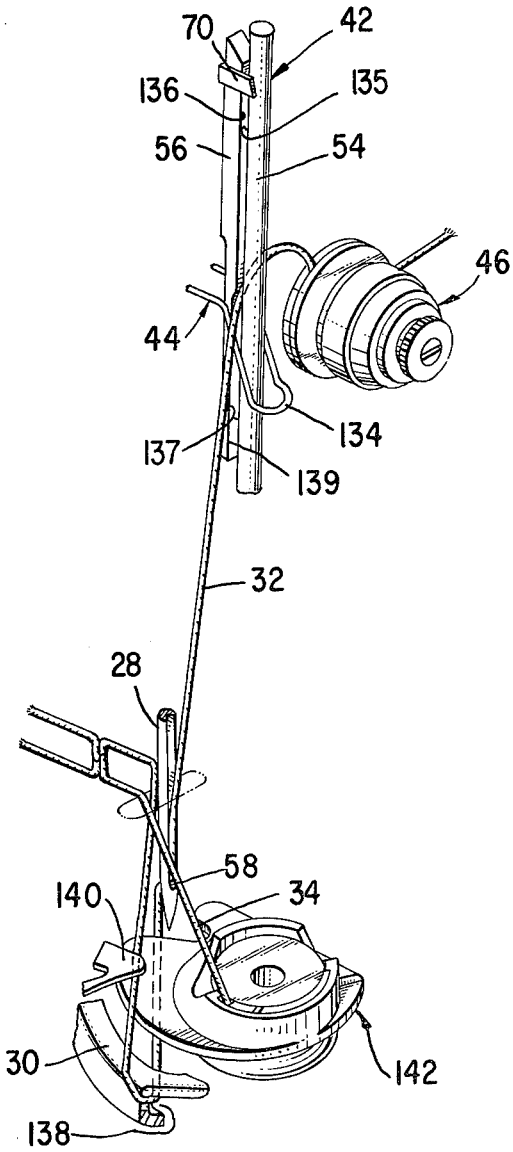
Figure 7:
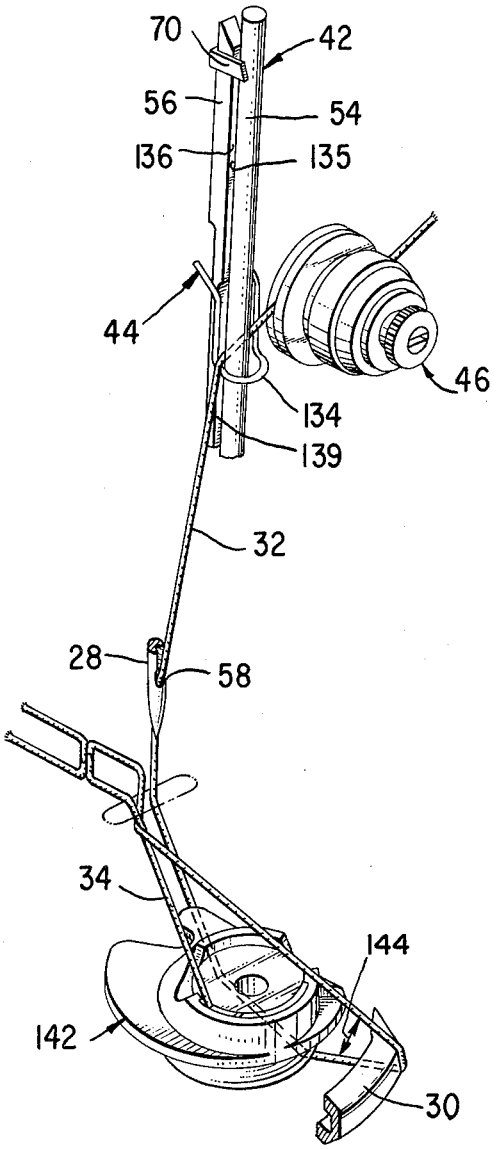

Tension in the thread during the first portion of the downward movement thereof in response to demand by the needle and looptaker serves to force the thread back into the throat 138 of the looptaker (FIG. 5), and enable the looptaker to move the thread under and through a hold down tab 140 for a bobbin case 142 without difficulty (FIG. 6). The maximum amount of thread is required by the looptaker just before a loop 144 is cast off the bobbin case in the position of FIG. 7, and any thread unavailable from the thread holder and required by the looptaker to meet such maximum demand is obtained from the tensioning device with only slight tension being exerted thereon by the tensioning device both because the thread is obtained merely by altering the exit point of thread from the tensioning device instead of by pulling thread from the supply spool in response to looptaker demand, and because the thread is obtained from the upper portion of the tensioning device where little force is exerted against the thread. The extent to which the exit point of thread at the tensioning device is altered to provide additional thread depends upon the thickness of material being sewn since a greater amount of thread is required for thick materials than for thin materials and a greater change in the thread exit point on the tensioning device is required to satisfy the demand.

Figure 8:
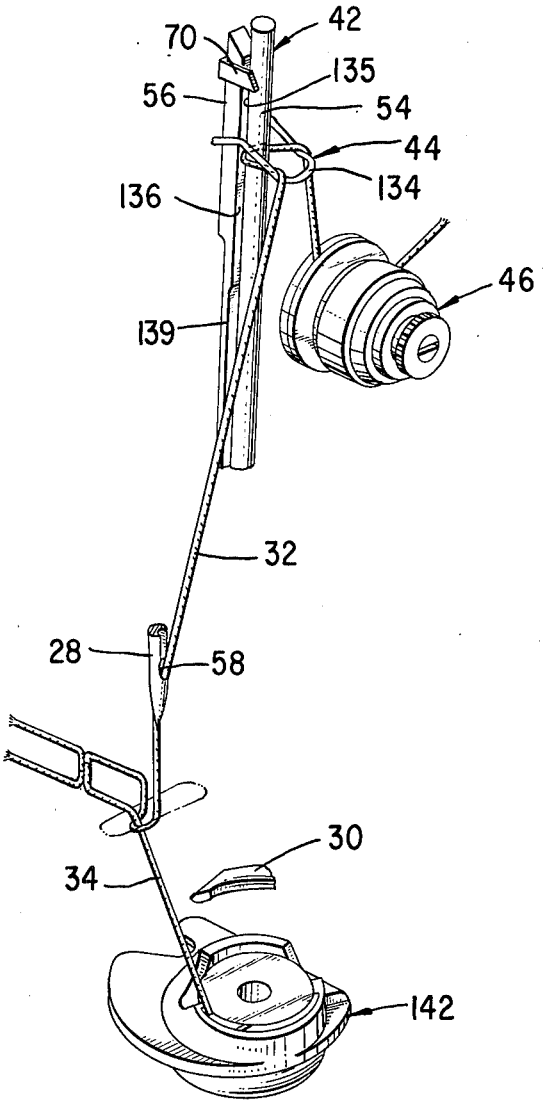

After cast-off, the thread is lifted by the takeup member in the thread holder to the temporary retention position between surfaces 135 and 136. As the thread is moved upwardly by the takeup member the cast off loop is closed around the bobbin thread 34 and a stitch is preset (see FIG. 8) with light tension without thread being pulled from the supply spool, after which the material is moved under the presser foot by the feed dog and the takeup continues to lift the thread to complete setting of the stitch with greater tension while thread is pulled from the supply spool through the tensioning device. Presetting of the stitch, that is before the stitch is moved under the presser foot, permits the takeup member to eliminate slack which might otherwise produce a halo in the stitch. Further, since there is no check spring, in the system of the invention to apply tension to the thread during the presetting of the stitch and the material is firmly held by the presser foot during the final stage of stitch setting, the puckering of materials as commonly experienced with conventional thread handling systems due to excessive thread tension is avoided. Also, since there is no check spring to flex before setting a stitch and a stitch can therefor be set more quickly than would otherwise be the case, it is possible to advance operation of the feed dog such that the feeding of material during the formation of one stitch can be readily completed before needle penetration for the next stitch, and damage to the needle prevented. The absence of a check spring also assures the formation of initial stitches in material with the same tension as subsequent stitches since the same tension is exerted on the thread by the thread holder and tensioning device during stitch formation whether a first stitch or a last stitch is being formed. This is in contrast to the result experienced with a conventional system including a check spring where the tightness of the first few stitches varies considerably due to the fact that the check spring adds a varying tension to the thread until fully flexed and full flexure isn't achieved until at least several stitches have been formed.

Figure 9:
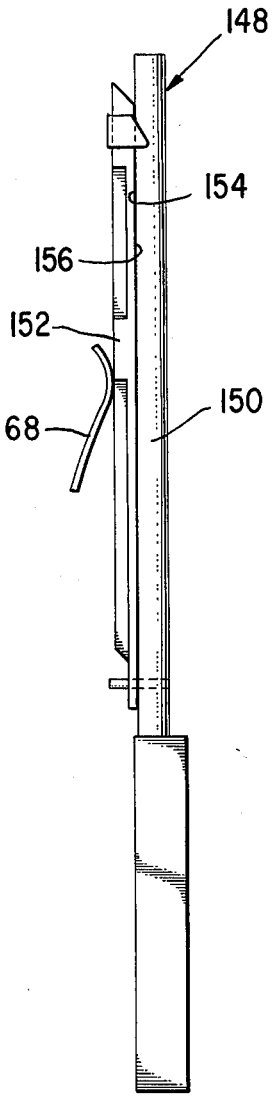
FIGS. 9, 10 and 11 are end elevational views showing modified forms of thread holders for use in the system of the invention.
Figure 10:
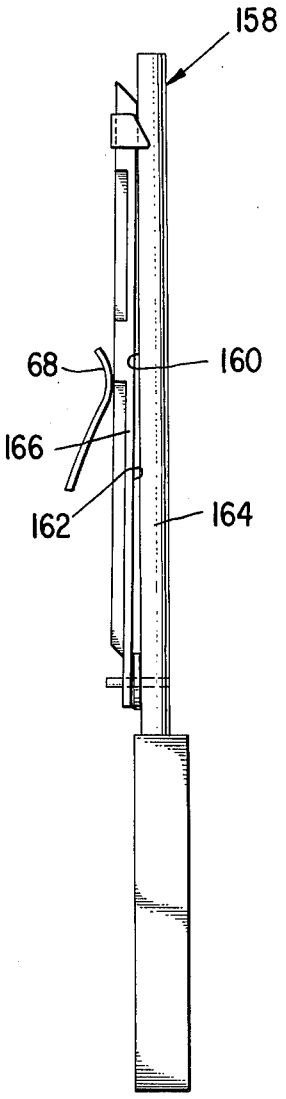
Figure 11:
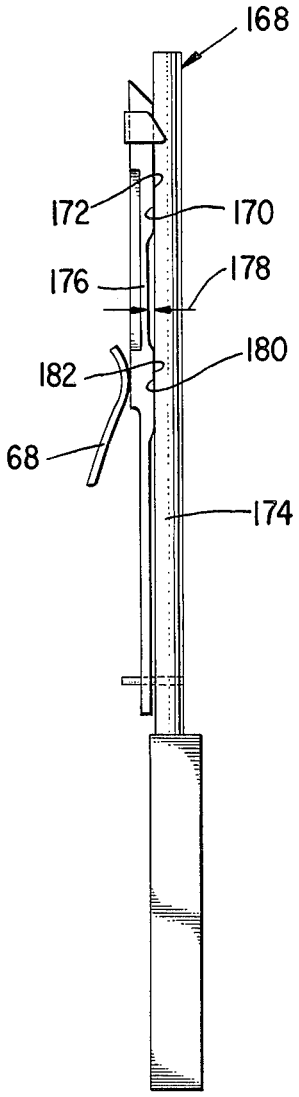

Thread holder 42 has been described as including elongated members 54 and 56 adapted to apply light tension to thread only when it is between surfaces 135 and 136 on the upper end portions of the members. However, a thread holder for use in the system of the invention may be differently constructed. A thread holder 148 for use in the thread handling system may, for example, be formed on cooperating elongated members 150 and 152 with extensive thread engaging surfaces 154 and 156 respectively as shown in FIG. 9 to contact thread throughout the entire length of its movement up and down in the thread holder for continuous control. Another thread holder 158 for use in my system may be constructed as shown in FIG. 10 with opposing thread engaging surfaces 160 and 162 on members 164 and 166 respectively which diverge slightly in the downward direction at an acute angle and thereby cause thread to be released and grabbed at a location intermediate the ends thereof. Still another form of thread holder 168 may be constructed as shown in FIG. 11 with thread engageable surfaces 170 and 172 on members 174 and 176 respectively for holding thread when the takeup moves downwardly after stitch setting, with a gap 178 between the members to permit thread to fall freely for a time and so relieve stress at the upper end of the eye of the sewing needle after penetration by the needle of material being sewn, and with thread engageable surfaces 180 and 182 between the members 174 and 176 for applying tension to the needle thread between loop seizure time and cast-off.

It is to be understood that the present disclosure relates to preferred embodiments of the invention which are for purposes of illustration only and are not to be construed as a limitation of the invention. Numerous alterations and modifications of the structures herein disclosed will suggest themselves to those skilled in the art, and all such modifications, and alterations which do not depart from the spirit and scope of the invention are intended to be included within the scope of the appended claims.

I claim:

1. In a sewing machine wherein a sewing needle and looptaker cooperate in the formation of locked stitches in a fabric, the combination comprising: a thread source; a thread tensioning device to which thread extends from the thread source; a thread holder into which the thread extends from the tensioning device and beyond which the thread extends to the needle; and a takeup for setting stitches and pulling thread through the tensioning device from the supply, the takeup being movable in a stitch setting direction with thread to one end of its operating range whereat the thread is positioned for temporary retention in the holder, and moveable in the opposite direction free of the thread to the other end of said operating range to permit thread to move in the holder from the temporary retention position to a position of reengagement with the takeup at said other end of its operating range and to thereby shorten the path for thread between the tensioning device and needle to supply a quantity of thread for use by the needle and looptaker; said thread holder including a pair of elongated members disposed in relation to the thread to engage and apply a restraining force to thread during at least an initial but substantial part of its movement away from the retention position; the tensioning device being provided with thread guiding means and being disposed on one side of the elongated members of the thread holder in a position relative to ends of the operating range of the takeup to enable thread while the takeup is in the said other end of its operating range to be withdrawn from the tensioning device without pulling thread from the thread source and with less tension in the thread than when pulled from the thread source by operation of the takeup.

2. The combination of claim 1 including a spring which biases one of the elongated members toward the other to cause the members to apply said restraining force to the thread.

3. The combination of claim 2 wherein the elongated members are adapted to apply the restraining force to the thread only during said initial but substantial part of its movement away from the retention position.

4. The combination of claim 2 wherein the elongated members are adapted to apply the restraining force to the thread throughout movement of the thread into and away from the retention position in the thread holder.

5. The combination of claim 2 wherein the elongated members diverge at an acute angle away from the said retention position.

6. The combination of claim 2 wherein the elongated members are adapted to release the thread during an intermediate and final portion of its movement in the thread holder toward the position of reengagement with the takeup.

7. The combination of claim 1 wherein said one end of the operating range of the takeup member is at a level in the machine above the level of the top edge of the tensioning device and the other end of the operating range of the takeup member is below the level of the top edge of the tensioning device.

8. The combination of claim 7 wherein the thread guiding means for the tensioning device is disposed to guide thread from the supply through a bottom portion of the device to an exit which is near the top edge of the device when the takeup member is at said one end of its operating range.

9. The combination of claim 8 wherein the tensioning device includes thread engageable plates and means causing said plates to squeeze the thread with greater force in the bottom portion of the device than in the top portion.

10. The combination of claim 9 wherein the means causing said thread engageable plates to squeeze the thread with greater force in the bottom portion of the tensioning device than in the top portion includes a pressure plate with one pin thereon which extends through the top portion of one of the said thread engageable plates to engage a top portion of the other thread engageable plate and with at least one other pin which engages the bottom portion of said one thread engageable plate, spring means acting upon the pressure plate to cause said one and other pin to forceably bear against the said one and other thread engaging plates respectively, and fixed structure to prevent movement of said other thread engaging plate in response to the force of the spring.

11. The combination of claim 10 wherein said one other pin and another pin extend from the pressure plate to engage the bottom portion of said one thread engageable plate.

* * * * *